US005544613A

United States Patent [19]

Scarborough et al.

[11] Patent Number: 5,544,613

[45] Date of Patent: Aug. 13, 1996

[54] FOOT REST FOR BOATS

[75] Inventors: Charles S. Scarborough, Rockwood, Tenn.; Robert M. Kelly, Wilmington, Del.; Rodney W. Gaylor, Oliver Springs; Patrick J. Rogers, Rockwood, both of Tenn.

[73] Assignee: Dagger Canoe Co., Inc., Harriman, Tenn.

[21] Appl. No.: 514,453

[22] Filed: Aug. 11, 1995

[51] Int. Cl.[6] ..... B63B 17/00

[52] U.S. Cl. ..... 114/363; 114/347

[58] Field of Search ..... 114/347, 363; 297/195, 423; 441/70

[56] References Cited

U.S. PATENT DOCUMENTS

| | | | |
|---|---|---|---|
| 3,982,293 | 9/1976 | Lagervall | 114/363 |
| 4,503,799 | 3/1985 | Masters | 114/363 |
| 4,589,365 | 5/1986 | Masters | 114/347 |
| 4,744,327 | 5/1988 | Masters | 114/347 |
| 4,942,840 | 7/1990 | Masters et al. | 114/363 |

*Primary Examiner*—Jesus D. Sotelo
*Attorney, Agent, or Firm*—Pitts & Brittain, P.C.

[57] ABSTRACT

A foot rest (10) for supporting the feet of a boater in a boat such as a canoe or kayak. The foot rest (10) is movable along the length of the boat such that boaters having longer or shorter legs than others may be accommodated while requiring only one adjustment. The foot rest (10) includes a mounting rail (12), a foot support block (14), and a retainer rail (16). The mounting rail (12) is a linear member and is disposed along the longitudinal axis of the boat in front of a seat. The mounting rail (12) may be formed separately from and secured to the boat. The mounting rail (12) defines a plurality of indexing receptors (24) opening on the top side thereof for receiving cooperating indexing members (30) carried by the foot support block (14). The foot support block (14) includes a pair of foot engagement pads (26) carried at either end of a bridge (28). The indexing members (30) are configured to be closely received by and cooperate with the indexing receptors (24) defined by the mounting rail (12). Each foot engagement pad (26) defines an engagement surface (32) oriented to engage the bottom of a boater's foot. The retainer rail (16) is received by the foot support block (14) and is releasably secured to the mounting rail (12) in a conventional fashion. The top surface of the retainer rail (16) is dimensioned to be closely received between the foot engagement pads (26) such that when the position of the foot support block (14) is being adjusted, the foot support block (14) is prevented from rotating about a vertical axis such that relative alignment of the foot support block (14) is maintained with respect to the mounting rail (12).

16 Claims, 4 Drawing Sheets

FOOT REST FOR BOATS

TECHNICAL FIELD

This invention relates to the field of boating. More specifically, this invention relates to a movable footrest carried by the hull of a boat such as a canoe or kayak.

BACKGROUND ART

In the field of boating it is well known that boats such as canoes or kayaks are typically not provided with a means for supporting a boater's feet. In most canoes, the boater must cross his legs and place his feet under him, or place his feet in front of him with nothing to support them. In a conventional kayak, the boater is restricted to placing his feet in front of him. Without having support for the feet, any motivation the boater may impart on the boat must come from the upper torso. If support is provided for the feet, however, power may be derived through the boater's legs.

Other devices have been produced to be carried by the hull of a boat for supporting the feet of a boater. Typical of the art are those devices disclosed in the following U.S. patents:

| U.S. Pat. No. | Inventor(s) | Issue Date |
|---|---|---|
| 3,982,293 | O. L. Lagervall | Sept. 28, 1976 |
| 4,503,799 | W. E. Masters | Mar. 12, 1985 |
| 4,589,365 | W. E. Masters | May 20, 1986 |
| 4,744,327 | W. E. Masters | May 17, 1988 |
| 4,942,840 | W. E. Masters, et al. | July 24, 1990 |

The device disclosed by Masters ('799) in part discloses adjustable knee braces, each including a belt disposed under a seat member. The free ends of the belt are secured to each other over the seat member and the knees of the boater. The bottom of the seat member defines a plurality of grooves for receiving the belt member. In order to adjust the position of the belt member with respect to the longitude of the boat, the belt member is simply placed within a different groove. However, such a device does not assist in the support of the boater's feet.

The Lagervall ('293) device includes a pair of foot rest assemblies for securement to either side of a kayak. Each foot rest assembly includes a guide rail which slidable receives a foot rest. The position of the foot rest with respect to the guide rail is maintained using a spring biased pin received in one of a plurality of indexing receptors defined by the guide rail. However, such a device requires the adjustment of two foot rests in order to fully adjust for a particular boater. By requiring separate guide rails and foot rests, more weight is carried by the boat, and a greater amount of space within the boat is required than may otherwise be desirable. Further, it is well known that a greater number of parts required increases the expense and maintenance required.

The Masters ('365) device is a kayak in which the '293 device described above is incorporated. In the '365 device, the foot braces are carried by a runner defined by the kayak. However, this yields the same deficiencies as the '293 device as discussed.

Those devices disclosed by Masters ('840) and Masters, et al. ('327) are similar to those described above in that each is provided with two liner tracks and two corresponding foot rests. One track is secured to each side of a kayak and one foot rest is mounted to a track and is moveable along the length thereof to accommodate for taller and shorter boaters.

Other types of footrests have been provided as well. For example, some boats are provided with a bottom having deformations for supporting the feet of a boater. Thus, boaters of differing heights engage various deformations in order to support their feet. No adjustability is provided with such devices. Further, an inadequate surface cannot be provided for supporting the boater's feet without sacrificing the space within the boat.

Therefore, it is an object of this invention to provide a device for supporting the feet of a boater, the support being adjustable along the length of the boat to accommodate various boaters.

A further object of the present invention is to provide a means whereby the foot support is provided for supporting both of a boater's feet using a single device, thereby reducing the weight and space requirements.

Still another object of the present invention is to provide support for the feet of a boater whereby the support is less expensive than prior devices.

Yet another object of the present invention is to provide a foot support for boaters which may be formed integrally with a boat in order to minimize the additional weight of the foot support.

DISCLOSURE OF THE INVENTION

Other objects and advantages will be accomplished by the present invention which serves to support the feet of a boater in a boat such as a canoe or kayak. Moreover, in the preferred embodiment the foot rest is designed to be movable along the length of the boat such that boaters having longer or shorter legs than others may be accommodated while requiring only one adjustment. Due to the configuration of the present invention, the cost of manufacturing, the weight of, and the space required by the present invention is reduced as compared to prior art devices.

The foot rest of the present invention includes generally a mounting rail, a foot support block, and a retainer rail. The mounting rail is a linear member and is disposed along the longitudinal axis of the boat in front of a seat. The mounting rail may be formed separately from and secured to the boat. The mounting rail defines a plurality of indexing receptors on the left and fight sides thereof. Each indexing receptor opens on the top side of the mounting rail for receiving cooperating indexing members carried by the foot support block.

The foot support block is configured generally of a pair of foot engagement pads carried at either end of a bridge. At least one indexing member is carried by each foot engagement pad. The indexing members are configured to be closely received by and cooperate with the indexing receptors defined by the mounting rail. Each foot engagement pad defines an engagement surface oriented to engage the bottom of a boater's foot. Specifically, the engagement surface is substantially perpendicular to the boater's shin such that the ankle is not bent such that any force exerted on the feet of the boater is transferred directly to the the support block without the foot of the boater slipping along the engagement surface.

The retainer rail is received by the foot support block and is releasably secured to the mounting rail in a conventional fashion. As illustrated, the retainer rail may be secured to the mounting rail using threaded fasteners. The retainer rail is received by the foot support block between the bridge and the indexing members. The retainer rail defines a recess along each side for receiving the indexing members when such are not engaged within the indexing receptors. The recesses are dimensioned to allow the indexing members to freely move therein when adjusting the position of the foot support block. The top surface of the retainer rail is dimensioned to be closely received between the foot engagement pads such that when the position of the foot support block is being adjusted, the foot support block is prevented from rotating about a vertical axis such that relative alignment of the foot support block is maintained with respect to the mounting rail.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A foot rest for boats incorporating various features of the present invention is illustrated generally at 10 in the figures. The foot rest for boats, or foot rest 10, is designed for supporting the feet of a boater in a boat such as a canoe or kayak. Moreover, in the preferred embodiment the foot rest 10 is designed to be movable along the length of the boat such that boaters having longer or shorter legs than others may be accommodated while requiring only one adjustment. Due to the configuration of the present invention, the cost of manufacturing, the weight of, and the space required by the present invention is reduced as compared to prior art devices.

Figure 1:
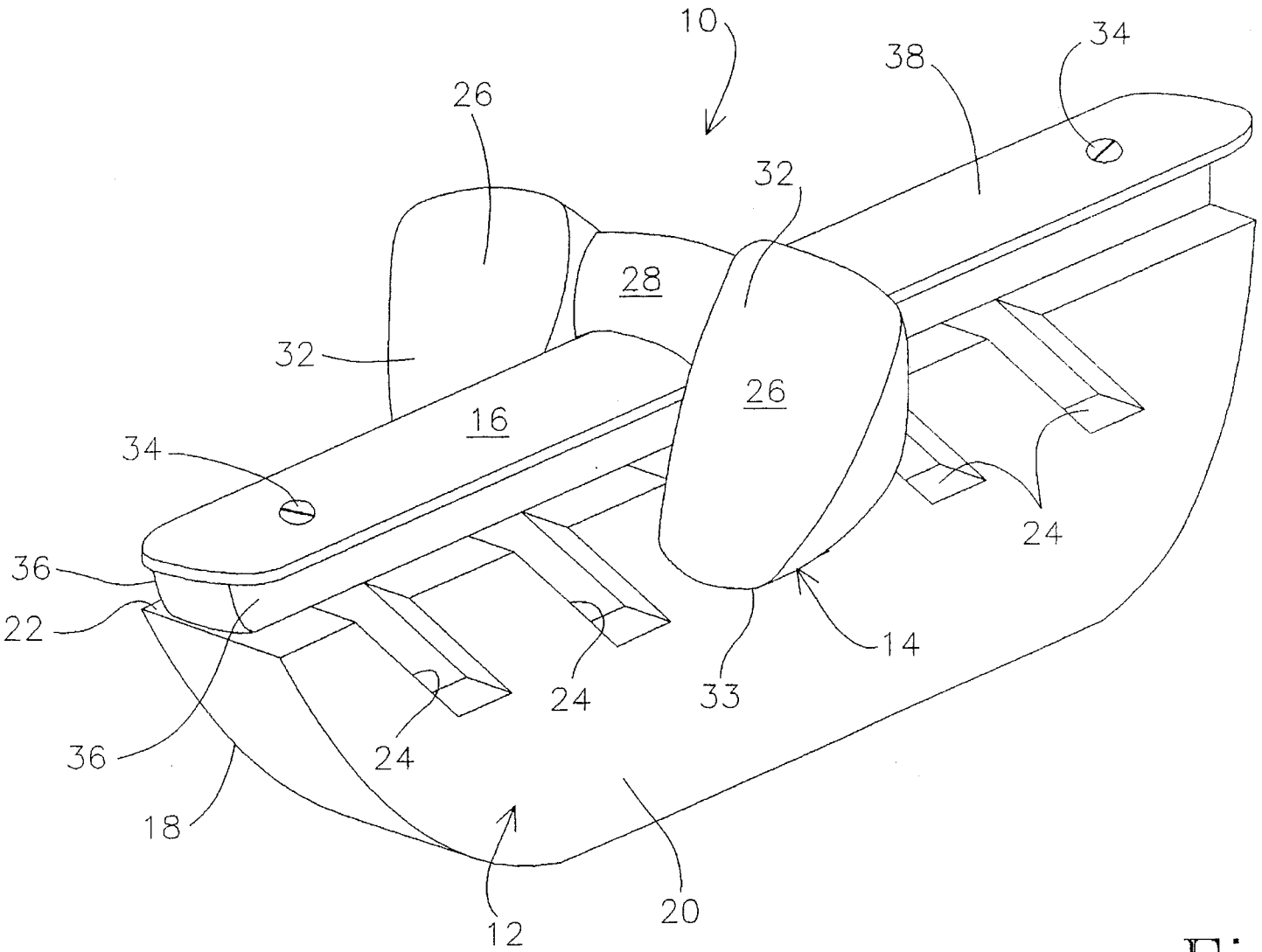
FIG. 1 is a perspective view of the foot rest for boats constructed in accordance with several features of the present invention.
Figure 2:
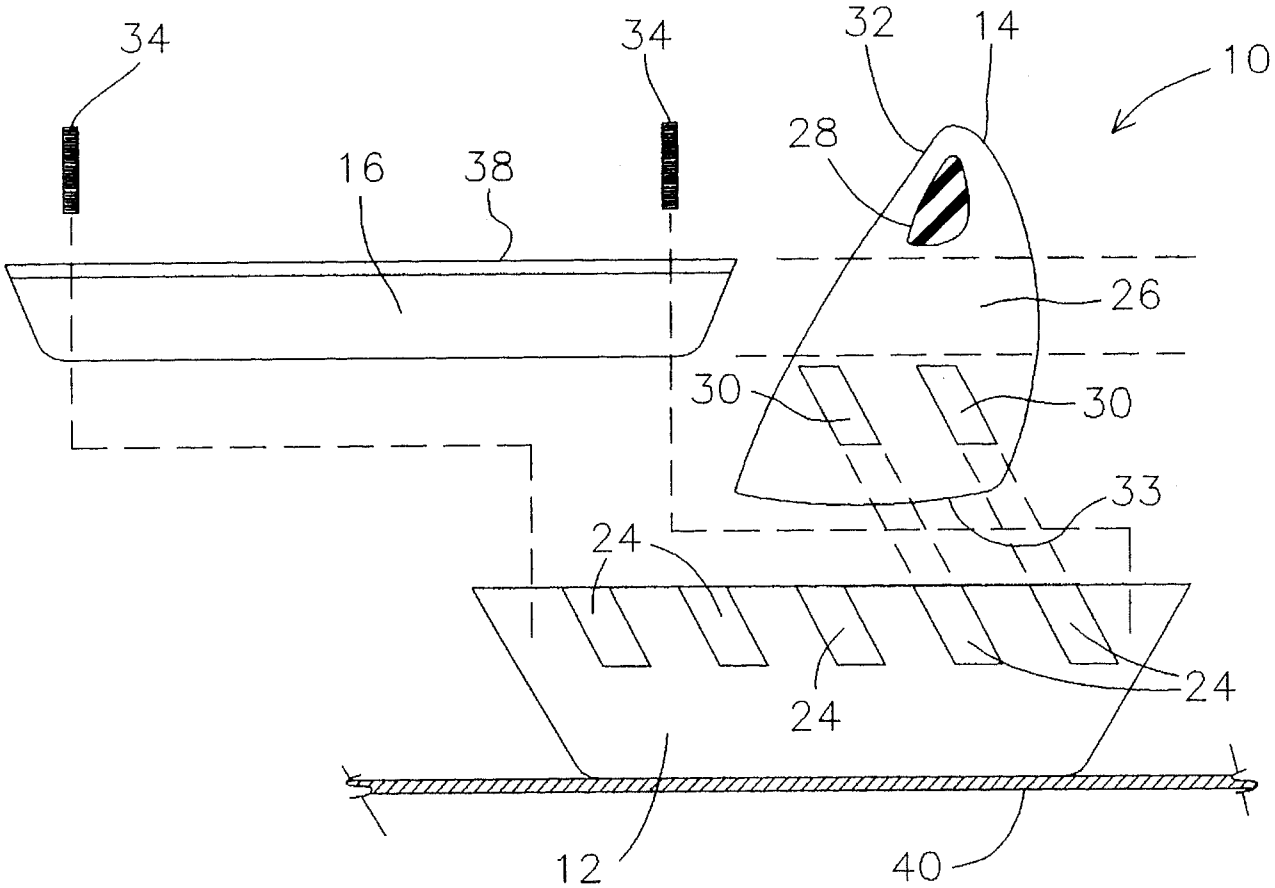
FIG. 2 illustrates an exploded side elevation view of the foot rest for boats shown in FIG. 1.
Figure 4:
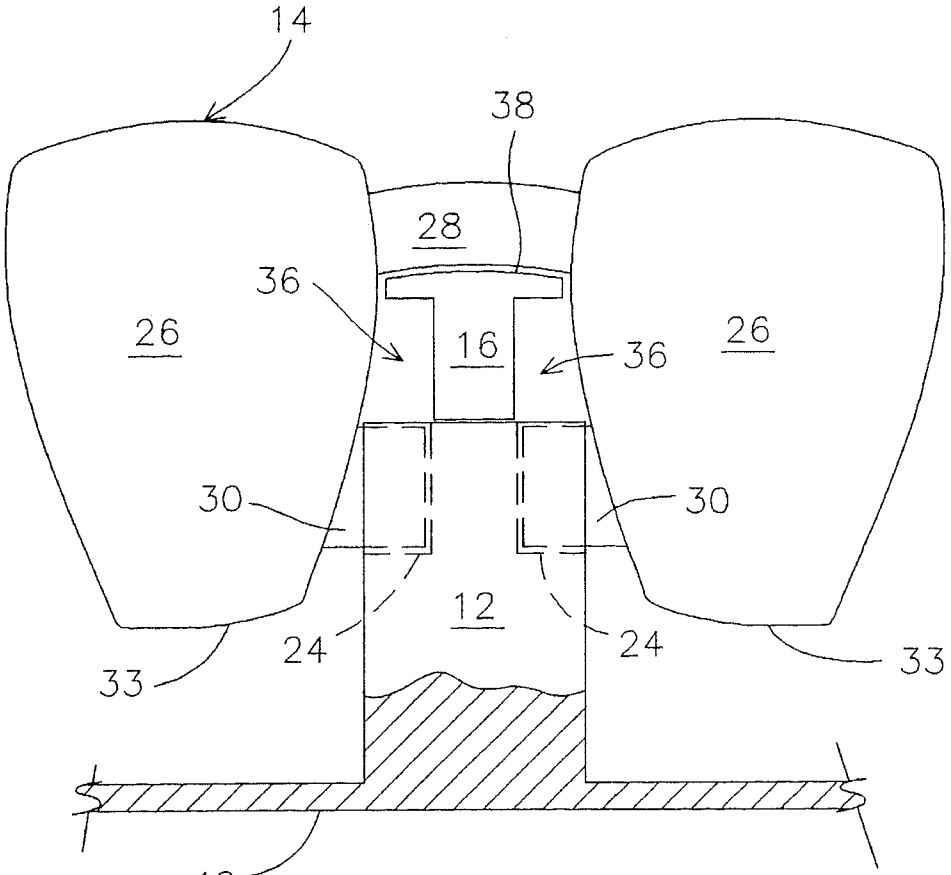
FIG. 4 is a front elevation view of an alternate embodiment of the foot rest for boats.
Figure 3:
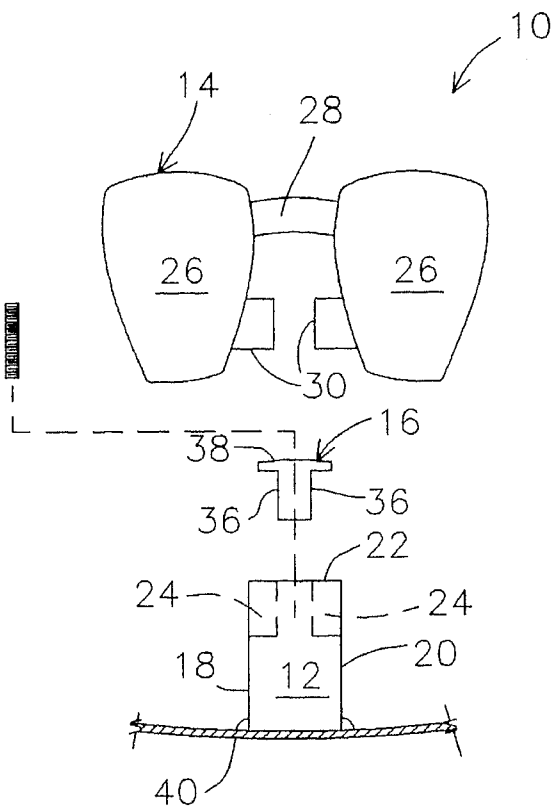
FIG. 3 illustrates an exploded front elevation view of the foot rest for boats shown in FIG. 1.

The foot rest 10 of the present invention includes generally a mounting rail 12, a foot support block 14, and a retainer rail 16. The mounting rail 12 is a linear member defining a substantially rectangular cross-section, thus having parallel left and right sides 18, 20 and a planar top side 22. The mounting rail 12 is disposed along the longitudinal axis of the boat 40 in front of a seat. As most clearly illustrated in FIGS. 2 and 3, the mounting rail 12 may be formed separately from and secured to the boat 40. The mounting rail 12 illustrated in FIGS. 2 and 3 is secured to the boat 40 in a conventional fashion such as by welding. Of course, it will be understood that measures must be taken when securing the mounting rail 12 to the boat 40 so as to not compromise the structural integrity of the boat 40. For example, although fasteners such as bolts or screws are not illustrated, it will be understood that proper seals must be incorporated to prevent leaks. Alternatively, as illustrated in FIG. 4, the mounting rail 12 may be fabricated integrally with the boat 40.

The mounting rail 12 defines a plurality of indexing receptors 24 on the left and right sides 18, 20 thereof. Each indexing receptor 24 opens on the top side 22 of the mounting rail 12 for receiving cooperating indexing members 30 carried by the foot support block 14. To this extent, the foot support block 14 is configured generally of a pair of foot engagement pads 26 carried at either end of a bridge 28. At least one indexing member 30 is carried by each foot engagement pad 26, each indexing member 30 extending from the respective foot engagement pad 26 toward the other. The indexing members 30 are configured to be closely received by and cooperate with the indexing receptors 24 defined by the mounting rail 12. The indexing receptors 24 and indexing members 30 are oriented in a direction such that when force is applied to the foot support block 14 via the boater's feet, such force is used to maintain the position of the foot support block 14 with respect to the mounting rail 12. In the illustrated embodiment, the top of the indexing receptors 24 and indexing members 30 are angled toward the boater. It will be seen that this orientation further assists the boater in adjusting the foot support block 14 in that the foot support block 14 is pulled toward the boater in order to disengage the indexing members 30 from the indexing receptors 24, after which, the foot support block 14 is moved in the desired direction in order to engage the indexing members 30 in another set of indexing receptors 30 to suit the needs of the boater.

The indexing members 30 carried by the foot support block 14 are configured to minimize the movement of the foot support block 14 with respect to the mounting rail 12 when the indexing members 30 are engaged with a cooperating set of indexing receptors 24. In the illustrated embodiment, two indexing members 30 are carried by each foot engagement pad 26. In the illustrated embodiment, each indexing member 30, and accordingly each indexing receptor 24, defines a rectangular cross-section. Further, each indexing member 24 defines a length greater than its width. Each of these characteristics—i.e., quantity, geometry and dimensions—contributes to the stability of the foot support block 14. In an alternate embodiment, although not shown, it is envisioned that the indexing receptors 24 and indexing members 30 engage with each other in a dovetail fashion to increase stability of the foot support block 14 with respect to the mounting rail 12.

Each foot engagement pad 26 defines an engagement surface 32 oriented to engage the bottom of a boater's foot. Specifically, the engagement surface 32 is substantially perpendicular to the boater's shin such that the ankle is not bent. Therefore, any force exerted on the feet of the boater is transferred directly to the foot support block 14 without the foot of the boater slipping along the engagement surface 32. In the illustrated embodiment, the bottom surface 33 of each foot engagement pad 26 is disposed above the boat 40 when the indexing members 30 are fully engaged with a selected set of indexing receptors 24.

In order to assist in guiding the foot support block 14 along the mounting rail 12, a retainer rail 16 is received by the foot support block 14 and is releasably secured to the mounting rail 12 in a conventional fashion. As illustrated, the retainer rail 16 may be secured to the mounting rail 12 using threaded fasteners 34. The retainer rail 16 is received by the foot support block 14 between the bridge 28 and the indexing members 30. The retainer rail 16 defines a recess 36 along each side in order to define a "T"-shaped cross-section. Each recess 36 is provided for receiving the indexing members 30 when such are not engaged within the indexing receptors 24. The recesses 36 are dimensioned to allow the indexing members 30 to freely move therein when adjusting the position of the foot support block 14. Specifically, the recesses 36 define a height and depth at least equal to the height and length of the indexing members 30. The top portion 38 of the retainer rail 16 is dimensioned to be closely received between the foot engagement pads 26 such that when the position of the foot support block 14 is being adjusted, the foot support block 14 is prevented from rotating about a vertical axis such that relative alignment of the foot support block 14 is maintained with respect to the mounting rail 12.

Figure 5:
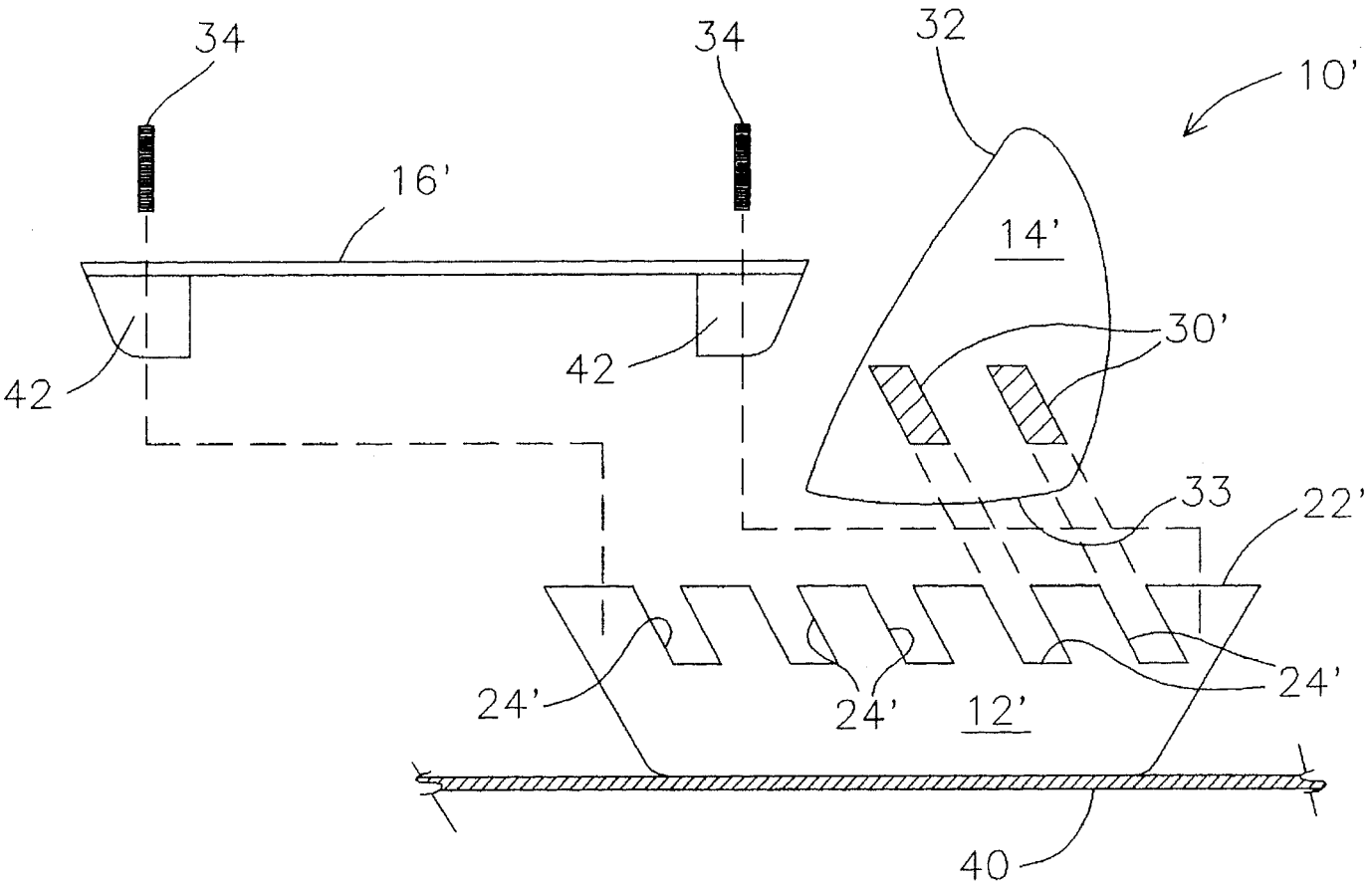
FIG. 5 is an exploded side elevation, partially in section, of an alternate embodiment of the foot rest for boats of the present invention.

As illustrated in FIG. 5, an alternate embodiment of the present invention inches a single indexing member 30' extending from one foot engagement pad 26 to the other, with the mounting rail 12' defining indexing receptors 24' extending from the left side 18' to the right side 20' thereof. Accordingly, the retainer rail 16' in such an embodiment defines a planar member 38' disposed above the mounting rail 12' a distance at least equal to the height of the indexing members 30' and is secured at either end to the mounting rail 12' via spacers 42 and threaded fasteners 34 In this embodiment, the bridge 28 previously described is obviated, as the indexing members 30' serve the purpose of maintaining the alignment of the foot support block 14' with respect to the mounting rail 12'. Although not illustrated, in an alternate of this embodiment, each indexing member is a post extending downward from the bridge of the foot support block, with the indexing receptors defined by the mounting rail being a recessed opening configured to closely receive the indexing post. It will be understood that other equivalent embodiments may be derived as well.

From the foregoing description, it will be recognized by those skilled in the art that a foot rest for boats offering advantages over the prior art has been provided. Specifically, the foot rest provides a device for supporting the feet of a boater, the device being adjustable to accommodate boaters have longer or shorter legs than others. The device of the present invention is easily adjustable, requiring only one adjustment for both feet. Further, because only one mounting assembly is required, the present invention weighs less and requires less space than conventional devices of the prior art.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, We claim:

1. A foot rest for supporting the feet of a boater seated in a boat, said foot rest comprising:

a mounting rail positioned along a longitudinal axis on the boat, said mounting rail defining a plurality of indexing receptors;

a foot support block including a pair of foot engagement pads carried at either end of a bridge, each of said pair of foot engagement pads carrying at least one indexing member between said pair of foot engagement pads and extending toward the other of said pair of foot engagement pads, said indexing member being configured to be closely received within one of said plurality of indexing receptors defined by said mounting rail; and a retainer rail slidably received by said foot support block between said pair of foot engagement pads and releasably secured to said mounting rail, said retainer rail defining linear recesses dimensioned to slidably receive said indexing member when said indexing member is retracted from said indexing receptor.

2. The foot rest of claim 1 wherein said mounting rail is separate from and secured to said boat.

3. The foot rest of claim 1 wherein said mounting rail is integrally formed with the boat.

4. The foot rest of claim 1 wherein each of said indexing receptors and said indexing member each define a rectangular cross-section.

5. The foot rest of claim 1 wherein each of said indexing receptors and said indexing member are oriented with a top thereof angled toward the boater such that force exerted through the boater's legs serves to retain the indexing member within a cooperating one of said indexing receptors.

6. The foot rest of claim 1 wherein said bridge is configured to be closely received by one of said plurality of indexing receptors, said bridge thus being said indexing member, said retainer rail recesses cooperating to define a through opening for slidably receiving said bridge.

7. The foot rest of claim 1 wherein said retainer rail includes a top surface dimensioned to be closely received between said pair of foot engagement pads to prevent rotation of said foot support block along a vertical axis and maintain alignment between said foot support block and said mounting rail.

8. A foot rest for supporting the feet of a boater seated in a boat, said foot rest comprising:

a mounting rail positioned along a longitudinal axis on the boat, said mounting rail defining a plurality of indexing receptors, a foot support block including a pair of foot engagement pads carried at either end of a bridge, each of said pair of foot engagement pads carrying at least one indexing member between said pair of foot engagement pads and extending toward the other of said pair of foot engagement pads, said indexing member being configured to be closely received within one of said plurality of indexing receptors defined by said mounting rail, said indexing receptors defining a rectangular cross-section and being oriented with a top thereof angled toward the boater such that force exerted through the boater's legs serves to retain the indexing member within a cooperating one of said indexing receptors; and a retainer rail slidably received by said foot support block between said pair of foot engagement pads and releasably secured to said mounting rail, said retainer rail defining linear recesses dimensioned to slidably receive said indexing member when said indexing member is retracted from said indexing receptor.

9. The foot rest of claim 8 wherein said mounting rail is separate from and secured to said boat.

10. The foot rest of claim 8 wherein said mounting rail is integrally formed with the boat.

11. The foot rest of claim 8 wherein said bridge is configured to be closely received by one of said plurality of indexing receptors, said bridge thus being said indexing member, said retainer rail recesses cooperating to define a through opening for slidably receiving said bridge.

12. The foot rest of claim 8 wherein said retainer rail includes a top surface dimensioned to be closely received between said pair of foot engagement pads to prevent rotation of said foot support block along a vertical axis and maintain alignment between said foot support block and said mounting rail.

13. A foot rest for supporting the feet of a boater seated in a boat, said foot rest comprising:

a mounting rail positioned along a longitudinal axis on the boat, said mounting rail defining a plurality of indexing receptors, a foot support block including a pair of foot engagement pads carried at either end of a bridge, each of said pair of foot engagement pads carrying at least one indexing member between said pair of foot engagement pads and extending toward the other of said pair of foot engagement pads, said indexing member being configured to be closely received within one of said plurality of indexing receptors defined by said mounting rail, said indexing receptors defining a rectangular cross-section and being oriented with a top thereof angled toward the boater such that force exerted through the boater's legs serves to retain the indexing member within a cooperating one of said indexing receptors; and a retainer rail slidably received by said foot support block between said pair of foot engagement pads and releasably secured to said mounting rail, said retainer rail defining linear recesses dimensioned to slidably receive said indexing member when said indexing member is retracted from said indexing receptor, said retainer rail defining a top surface dimensioned to be closely received between said pair of foot engagement pads to prevent rotation of said foot support block along a vertical axis and maintain alignment between said foot support block and said mounting rail.

14. The foot rest of claim 13 wherein said mounting rail is separate from and secured to said boat.

15. The foot rest of claim 13 wherein said mounting rail is integrally formed with the boat.

16. The foot rest of claim 13 wherein said bridge is configured to be closely received by one of said plurality of indexing receptors, said bridge thus being said indexing member, said retainer rail recesses cooperating to define a through opening for slidably receiving said bridge.

* * * * *